United States Patent [19]

Bolton et al.

[11] Patent Number: 4,555,983

[45] Date of Patent: Dec. 3, 1985

[54] APPARATUS FOR SECURING AND SEALING A PACKAGED TERMINAL AIR CONDITIONER TO A PLASTIC WALL SLEEVE

[75] Inventors: Theodore S. Bolton, Liverpool; Richard D. Lang, Chittenango, both of N.Y.

[73] Assignee: Carrier Corporation, Syracuse, N.Y.

[21] Appl. No.: 698,193

[22] Filed: Feb. 4, 1985

[51] Int. Cl.[4] ..... F24F 13/00

[52] U.S. Cl. ..... 98/114; 62/263; 312/101; 411/172; 248/27.1

[58] Field of Search ..... 62/263; 98/114; 312/101, 245, 257 SM; 411/172, 173, 174, 175; 248/27.1

[56] References Cited

U.S. PATENT DOCUMENTS

| | | | |
|---|---|---|---|
| 2,233,230 | 2/1941 | Tinnerman | 411/175 |
| 2,679,796 | 6/1954 | Froelich et al. | 98/114 |
| 3,986,492 | 10/1976 | White | 62/263 |
| 4,202,389 | 5/1980 | Ewald | 312/101 |
| 4,274,330 | 6/1981 | Witten et al. | 98/114 |

*Primary Examiner*—Ronald C. Capossela
*Attorney, Agent, or Firm*—Robert H. Kelly

[57] ABSTRACT

A plastic sleeve assembly and an air conditioning unit are disclosed for mounting the air conditioning unit in a through-the-wall application. The sleeve assembly includes flange members with screw holes therethrough and standoffs about the screw holes, such that the air conditioning unit, having an L-shaped sealing flange thereon, when inserted into the sleeve and fastened thereto, causes the standoff on the flange to be in compression and not tension as the standoff makes contact with the L-shaped sealing flange when a fastener secures the air conditioner in the sleeve.

6 Claims, 4 Drawing Figures

APPARATUS FOR SECURING AND SEALING A PACKAGED TERMINAL AIR CONDITIONER TO A PLASTIC WALL SLEEVE

BACKGROUND OF THE INVENTION

This invention relates generally to a through-the-wall sleeve for a packaged terminal air conditioning unit. More specifically, the present invention relates to a non-metallic wall sleeve including means for securing an air conditioning unit, having an L-shaped weather strip angle along the sides thereof, to a flange of the non-metallic sleeve.

Air conditioning units which are commonly used for light commercial applications such as hotels, dormitories, and office buildings often are of the type known as a packaged terminal air conditioner. These packaged terminal air conditioners extend through the wall of the enclosure and normally have a condensing section located in communication with the ambient air for discharging heat energy. An evaporator section is provided in communication with the enclosure air for conditioning said air as it is drawn through the unit. Packaged terminal air conditioning units may be designed such that a portion of the unit is encased within the wall in a sleeve. The remaining portion of the unit is typically located within the enclosure to be conditioned and has readily accessible controls thereon and is encased within a decorative cover.

Normally, through-the-wall installation can be made in masonry or wood frame walls by installing the sleeve through the wall during the construction of the building and installing the air conditioning unit in the sleeve upon completion of the building.

Previous wall sleeves for packaged terminal air conditioners (although air conditioner units are described herein, packaged units may also be heat pumps or the like) have been constructed from sheet metal. This type of wall sleeve comprises a box formed by a top, a bottom, and two sides, but having the front and back open. Generally, a grille is fastened to the rear or outside opening, while the air conditioner unit is introduced into the sleeve through the front opening. The front opening of the sleeve is bound by a molding formed by bending the front edges of the top, the two sides and the bottom at right angles to form four flanges lying in the same plane with the long leg of an L-shaped weather sealing flange attached vertically along the sides of the air conditioning unit chassis. Accordingly, when the unit chassis is introduced into the sleeve the short leg of the L-shaped weather sealing flange mates perpendicularly with the side flanges on the sleeve while a gap is left between the flange of the sleeve and the long leg of the weather sealing flange of the air conditioning unit. Gasket material or weather tight caulking is generally applied in the gap between the sleeve and the air conditioning unit to insure a weather tight installation. However, when screws installed through the weather sealing flange of the air conditioning unit and the flange of the wall sleeve are tightened to secure the air conditioner chassis to the sleeve, the metal flange of the sleeve is distorted as the weather tight caulking is compressed between the wall sleeve and the air conditioning unit. This distortion of the flanges was not detrimental to the sleeve, however, since the material around the fastener holes in the sleeve was not broken, but was only bent since it was only ductile sheet metal, and the air conditioning unit could be removed and replaced and the mounting screws could still be secured through the weather sealing flange to the distorted wall sleeve flange.

However, with the introduction of non-metallic or plastic sleeves, the flanges on the sleeves did not distort when the mounting screws for securing the air conditioning unit chassis to the flanges of the sleeve were tightened, but the sleeve flanges fractured and broke.

SUMMARY OF THE INVENTION

Therefore, it is an object of the present invention to provide a unitary non-metallic wall sleeve for a packaged terminal air conditioner.

It is another object of the present invention to provide a non-metallic wall sleeve for a packaged terminal air conditioner such that the flanges around the wall sleeve will not break when the air conditioning unit is installed into and secured to the sleeve with a plurality of screw fasteners.

It is a further object of the present invention to provide a plastic wall sleeve for a packaged terminal air conditioner such that the material around the screw holes of the flanges around the wall sleeve will be in compression and not in tension.

These and other objects are achieved according to a preferred embodiment of the present invention by providing a plastic wall sleeve with an embossment around the screw holes in the flanges of the sleeve used for receiving the fasteners for securing the air conditioner chassis to the sleeve. The embossment has a height equal to the length of the short leg of an L-shaped weather sealing flange attached to the air conditioning unit such that when the fastening screws are fully torqued the sleeve flange is under compression. Accordingly, there is no tension forces on the sleeve flange to break it and the air conditioning unit can be secured and sealed without damage to the plastic sleeve.

The various features of novelty which characterize the invention are pointed out with particularity in the claims annexed to and forming a part of this specification. For a better understanding of the invention, its operating advantages, and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The preferred embodiment described herein will refer to a non-metallic through-the-wall sleeve and air conditioning unit chassis for use as a packaged terminal air conditioning unit. It is to be understood that this invention has like applicability to other types of packaged terminal units including heat pumps, electric resistance heaters, unitary hydronic units, and other similar applications.

Figure 1:
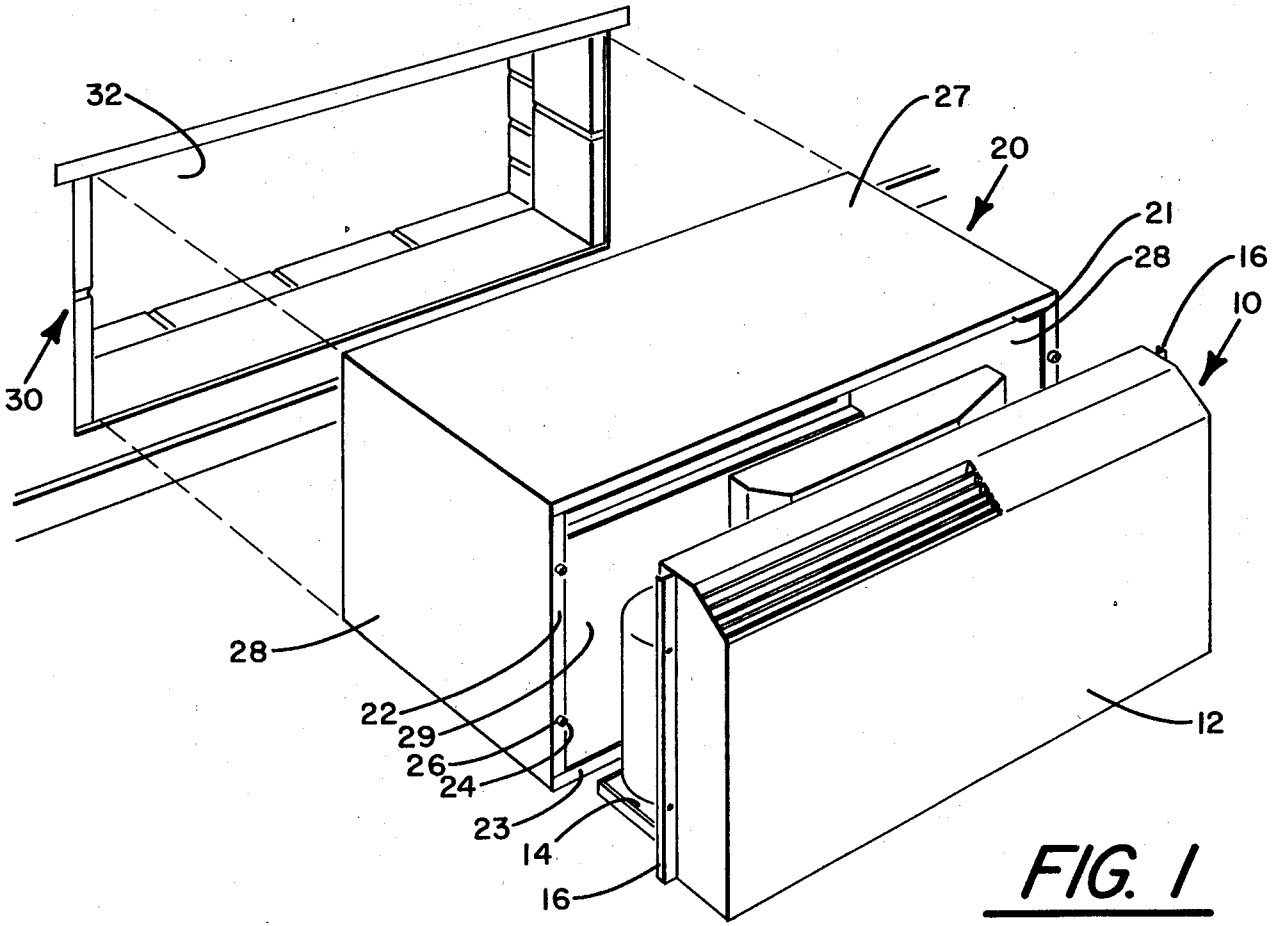
FIG. 1 is an exploded perspective view of a packaged terminal air conditioning unit insertable in a through-the-wall sleeve.

Referring first to FIG. 1 there may be seen a packaged terminal air conditioning unit 10 having front cover 12 and chassis 14. The packaged terminal air conditioning unit is installed in a sleeve 20. The sleeve may be of either a thermoplastic material or a thermoset material, e.g. glass reinforced molded polyester manufactured by Premix Inc. The sleeve 20 is typically mounted within the wall 30 of the enclosure such that the front cover 12 is visible to an occupant of the enclosure while the remainder of the unit is supported in a aperture 32 in the wall 30 of the enclosure. The sleeve 20 is box-like in shape having a top 27, two sides 28, and a bottom 29 wherein the front and back are open. The sleeve may be molded as one piece, or a plurality of pieces glued together from sheet molding compound. The front opening of the sleeve 20 has a flange or molding, generally perpendicular to the top, bottom and side surfaces of the sleeve, forming top flange 21, bottom flange 23, and side flanges 22.

As seen in FIG. 1, the chassis 14 has an L-shaped mounting flange 16 attached to the sides thereof. This mounting flange may be a piece of angle stock secured to the chassis by welding or the like. The mounting flange is adapted to coact with side flanges 22 of the sleeve 20 to secure the unit 10 to the sleeve 20.

Figure 2:
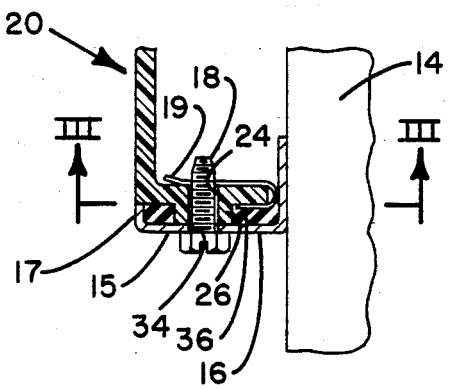
FIG. 2 is a plan view, partly in section, of a fastener means securing a packaged terminal air conditioner to a wall sleeve utilizing the present invention.

Referring now to FIG. 2 there may be seen a sectioned plan view of part of the unit 10 enclosed in the sleeve 20. The chassis 14 has the L-shaped mounting flange 16 attached thereto. The chassis 14 of the unit 10 is secured to the sleeve 20 by fasteners 18.

For securing the chassis 14 to the sleeve 20 with the fasteners 18, side flanges 22 are molded perpendicularly inward and have aperture 24 therethrough while the L-shaped mounting flange 16 has a corresponding aperture 34 through the long side of the L-shaped mounting flange. For securing the chassis 14 in place in the sleeve 20 with fastener 18, nut 19, such as a J-speed nut, is provided at each aperture 24.

A weather tight seal is maintained between the chassis 14 and the sleeve 20 by gasket material 36. Further, an embossment or standoff 26 is provided between the side flange 22 and the L-shaped mounting flange 16. The embossment is generally concentric with the aperture 24 in the side flange 22 and the aperture 24 may continue through the embossment. Moreover, the height or thickness of the embossment 26 is generally equivalent to the length of the short leg 17 of the L-shaped mounting flange 16. Thus, when the L-shaped mounting flange 16 of the chassis 14 is secured to the side flanges 22 of the sleeve 20 by fastener 18, the gasket material 36 is compressed to a depth no less than the height of the embossment or standoff 26. When the fastener 18 is fully torqued the side flange 22 is under compression and there is no tension force on the sleeve 20 to fracture it. Accordingly, the chassis is now secured and sealed to the sleeve without damage to the apertures or the side flanges of the sleeve.

Figure 3:
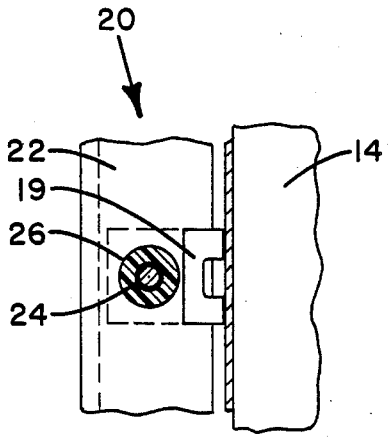
FIG. 3 is an elevational view, partly broken away, of a portion of a wall sleeve taken along line III—III of FIG. 2.

Referring now to FIG. 3 there can be seen an elevation view of the sleeve 20 showing the J-nut 19 attached to the side flange 22 and the embossment 26 circumscribed about the aperture 24. The embossment 26 is generally molded in circular form into the sleeve 20, but can be of various shapes such as rectangular, crescent, oval or the like, as long as its height is generally equivalent to the length of the short leg 17 of the L-shaped mounting flange 16.

Figure 4:
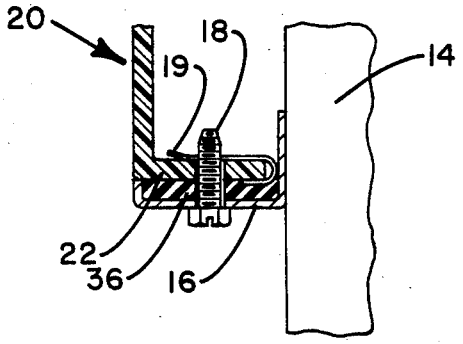
FIG. 4 is a plan view, partly in section, of a plastic wall sleeve of the prior art.

FIG. 4 shows a packaged terminal air conditioner secured to a plastic wall sleeve of the prior art. The L-shaped mounting flange 16 of the chassis 14 is secured to the side flange 22 of the sleeve 20 by fastener 18 coacting with J-nut 19. This arrangement includes gasket material 36 between the L-shaped mounting flange 16 and the side flange 22 of the sleeve 20. However, when the screw is over torqued, which occurs frequently because the installer cannot see the side flange of the sleeve, the gasket material 36 is continually compressed until the side flange 22 approaches the long leg 15 of the L-shaped mounting flange, thus overstressing the side flange 22 causing the flange to break.

It is contemplated that each side flange 22 of the sleeve 20 might have two apertures 24 therethrough. Each aperture 24 has a J-nut 19 or the like therearound to receive a fastener 18 insertable in a corresponding aperture 34 of the L-shaped mounting flange of the chassis. Once the chassis 14 is inserted in the sleeve 20 the fasteners 18 are used to secure the chassis in position. However, the embossment 26 maintains the side flange 22 in compression even if the fastener is over torqued.

Hence, as has been described herein a packaged terminal air conditioner may be secured to a plastic wall sleeve without breaking the flange of the sleeve.

The invention has been described with reference to a particular embodiment, however, it is to be understood by those skilled in the art that variations and modifications can be made within the spirit and scope of the invention.

What is claimed is:

1. An apparatus for securing a packaged terminal air conditioning unit in a through-the-wall aperture comprising:

a sleeve adapted to be mounted in the through-the-wall aperture including top, bottom, and two side walls, at least two flanges extending perpendicularly inwardly from the front of two of said walls, and said flanges having a plurality of apertures therethrough and each aperture having a standoff means therearound extending toward the front of said walls and nut means around each of said apertures on said flange, and a packaged terminal air conditioning unit assembly including a front panel and a chassis, said chassis adapted to be removably slidable into said sleeve and having a plurality of L-shaped mounting flanges extending perpendicularly outward from said chassis, said L-shaped mounting flanges having a plurality of apertures therethrough, each of said apertures in said L-shaped mounting flanges in spaced relation with said standoff means for receiving a fastener means first through said aperture in said L-shaped mounting flange, secondly through said standoff means and aperture in said flanges of said sleeve, and then through said nut means for moving said L-shaped mounting flange into contact with said standoff means whereby said standoff means in said sleeve is in compression.

2. The apparatus as set forth in claim 1 in which said sleeve is non-metallic.

3. The apparatus as set forth in claim 2 wherein said standoff means has a height substantially equal to the short leg of said L-shaped mounting flange.

4. The apparatus as set forth in claim 3 wherein said at least two flanges are carried by said two side walls of said sleeve.

5. A non-metallic sleeve for removably mounting therein a packaged terminal air conditioning unit having an L-shaped sealing flange extending outwardly therefrom, comprising:

a box means formed by a top, a bottom, two sides, an open back, and an open front;

two flanges carried by said two sides, said flanges extending inwardly in the plane of said open front, said flanges having nut means mounted thereon for receiving fastener means extending through the L-shaped sealing flange for securing the packaged terminal air conditioning unit in the sleeve, and standoff means in axial alignment with said nut means adapted to keep said flanges in spaced relation to the L-shaped sealing flange.

6. The non-metallic sleeve as set forth in claim 5 wherein said standoff means has a height substantially equal to the short leg of the L-shaped sealing flange to keep said two flanges in compression when said fastener means is tightened.

* * * * *